US006157302A

United States Patent [19]

Kolton et al.

[11] Patent Number: 6,157,302

[45] Date of Patent: Dec. 5, 2000

[54] ARTICLE IDENTIFICATION AND SURVEILLANCE TAG

[75] Inventors: Chester Kolton, Westfield; Michael Norman, East Brunswick, both of N.J.

[73] Assignee: B&G Plastics, Inc., Newark, N.J.

[21] Appl. No.: 09/351,196

[22] Filed: Jul. 9, 1999

[51] Int. Cl.[7] ..... G08B 13/14

[52] U.S. Cl. ..... 340/572.7; 340/572.1; 340/572.8; 340/572.9; 340/568.1; 340/571

[58] Field of Search ..... 340/572.7, 572.1, 340/572.8, 572.9, 571, 568.1

[56] References Cited

U.S. PATENT DOCUMENTS 5,306,055 4/1994 Mainetti ..... 292/320

5,524,463 6/1996 Schenkel et al. ..... 70/57.1

5,945,909 8/1999 Kolton ..... 340/572.1

*Primary Examiner*—Daniel J. Wu

*Assistant Examiner*—Hung Nguyen

*Attorney, Agent, or Firm*—Robin, Blecker & Daley

[57] ABSTRACT

An article protection tag comprising a first housing defining a compartment therein an EAS member disposed in the compartment a second housing fabricated separately from the first housing assemblable therewith, the second housing defining a channel extending through the second housing to openings in opposed end the tag, the channel being contiguous with the compartment a securement member disposed in the channel in juxtaposition with EAS member and extending through the openings of the first second housings to securement member couplings disposed exteriorly of the assembled first and second housings.

15 Claims, 5 Drawing Sheets

ARTICLE IDENTIFICATION AND SURVEILLANCE TAG

FIELD OF THE INVENTION

This invention relates generally to article identification protection and pertains more particularly to tags having size-adaptiveness to articles.

BACKGROUND OF THE INVENTION

One type of article identification device having security aspects and having virtual universal applicability to articles the so-called "seal", such as is shown in Mainetti U.S. Pat. No. 5,306,055. The seal of the '055 patent comprises a plastic body having a flexible cord passing through and secured in the body extending outwardly of the body to a cord free end which has hooks secured thereto and of configuration providing for irreversible insertion in the plastic body. In addition to the body and the cord, the seal of the '055 patent has plates bearing logo/article indication applied to the plastic body to close the same. In use, the hook and cord are passed through an opening of, e.g., a watch band, and the hook is then inserted into the plastic body.

A widespread further practice in article security is the use of so-called anti-theft tags which incorporate electronic article surveillance (EAS) markers. Such tags are secured to article and are removed or rendered inactive at checkout. Where fraudulent avoidance of checkout (shop-lifting) occurs, the markers are sensed by EAS systems, e.g., at store exits, and suitable alarm is generated.

One form of EAS marker in widespread use is in the form of a flat, thin, flexible, rectangular member which is applied adhesively to flat or curved surfaces of articles.

In pending, allowed U.S. patent application Ser. No. 09/088,839, commonly-assigned herewith, there is shown a seal incorporating therewithin an EAS marker.

Known seals, such as those above discussed, have a common shortcoming in that they are not adaptive to the size of articles with which they are assembled.

SUMMARY OF THE INVENTION

The primary object of the subject invention is to provide tags which are adaptive to the size of articles with which they are assembled.

In broad aspect, the invention provides tags, the article engaging elements of which can tightly circumscribe articles of different sizes. To this end, the invention provides an article protection tag comprising a first housing defining a compartment therein, an EAS member disposed in the compartment and a second housing, fabricated separately from the first housing and assemblable therewith, the second housing defining a channel extending through the second housing to openings in opposed ends of the tag, the channel being contiguous with the compartment and a securement member disposed in the channel in juxtaposition with the EAS member and extending through the openings of the first and second housings to securement member couplings disposed exteriorly of the assembled first and second housings.

The securement member is preferably an elongate flexible member. The first connectable securement element preferably includes a succession of ratcheting teeth longitudinally of the element. The second connectable securement element preferably includes structure for latching engagement with any of the ratcheting teeth and configured such that the first connectable securement element is movable only in one direction with respect to the second connectable securement element.

The securement member and the channel are mutually configured such that the securement member may be inserted through the channel after assembly of the first housing and the second housing.

The invention will be further understood from consideration of the following description of preferred embodiments thereof and from the drawings where like reference numerals identify like parts throughout.

DETAILED DESCRIPTION OF PREFERRED EMBODIMENTS

Figure 8:
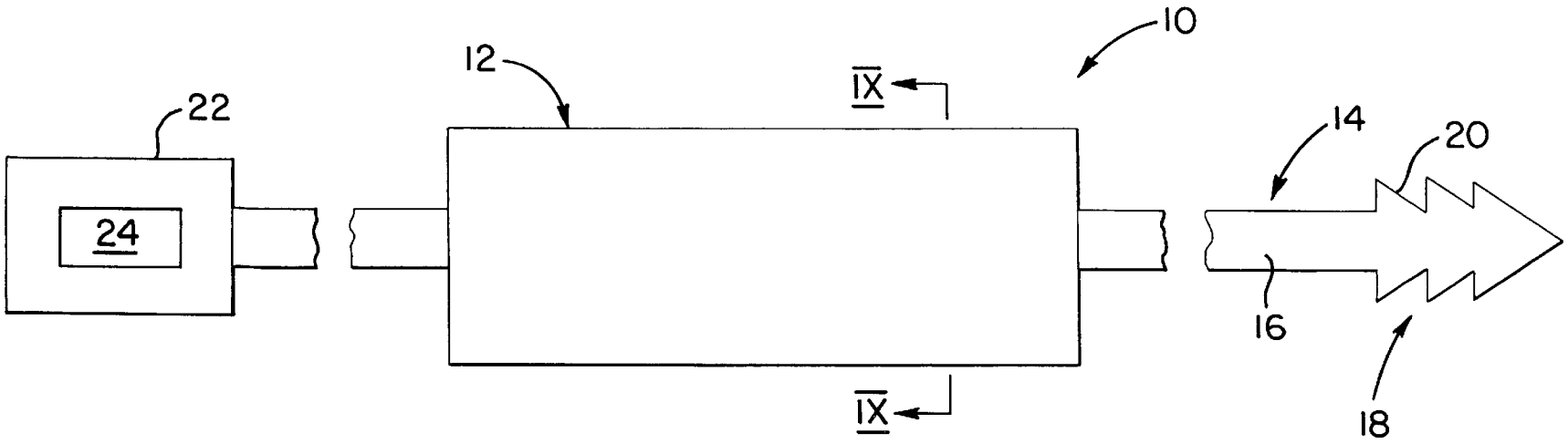
FIG. 8 is a top plan elevation of the tag of the invention with its securement member.

Referring to FIG. 8, tag 10 comprises tag body 12 and securement member 14, which is a form of so-called cable tie, having flexible filament 16, extending through body 12 and having a first end securement element 18, comprising a succession of ratchet teeth 20 and a second end securement element 22, comprising a head 22 having an interior opening 24 sized to receive element 18 when rotated ninety degrees from its illustrated disposition and to ensnare element 18 when then rotated to its illustrated disposition.

Turning to FIGS. 1–4, tag body housing 26 is a molded plastic member having outer sidewalls 28 and 30, interior walls 32 and 34, defining recesses 36 and 38 therebetween, and end walls 40 and 42. End wall openings 40*a* and 42*a* communicate with channel 44 formed between interior walls 32 and extending fully through housing 26. Joinder lip 46 bounds outer walls 28 and 30 and end walls 40 and 42.

Figure 3:
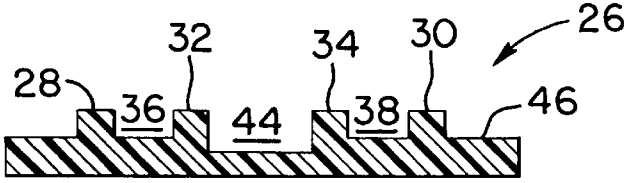
FIG. 3 is a sectional elevation of the FIG. 1 housing as would be seen from plane III—III of FIG. 1.
Figure 4:
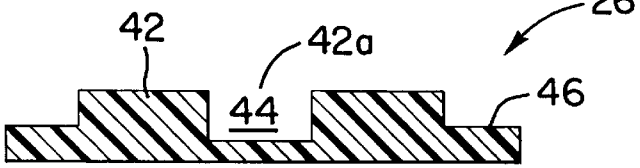
FIG. 4 is a sectional elevation of the FIG. 1 housing as would be seen from plane IV—IV of FIG. 1.
Figure 1:
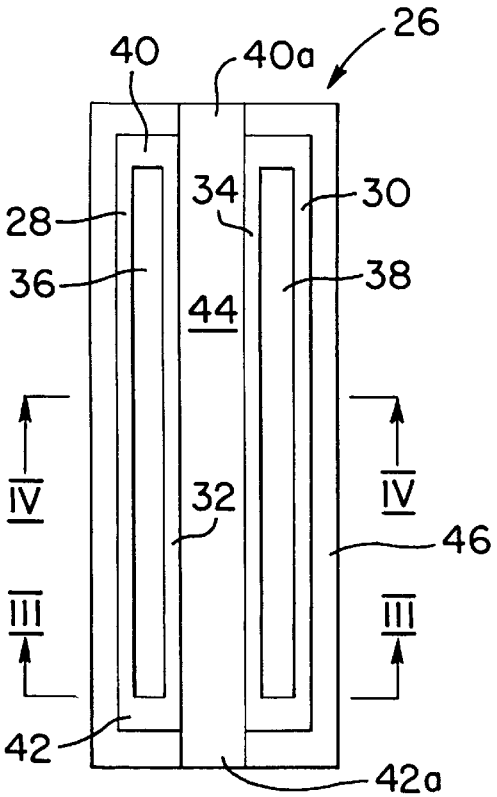
FIG. 1 is a top plan elevation of a first housing of a tag in accordance with the invention.
Figure 2:
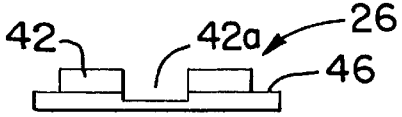
FIG. 2 is a front elevation of the FIG. 1 housing.
Figure 7:
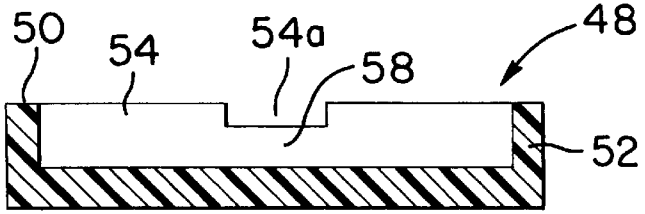
FIG. 7 is a sectional elevation of the FIG. 5 housing as would be seen from plane VII—VII of FIG. 1.
Figure 5:
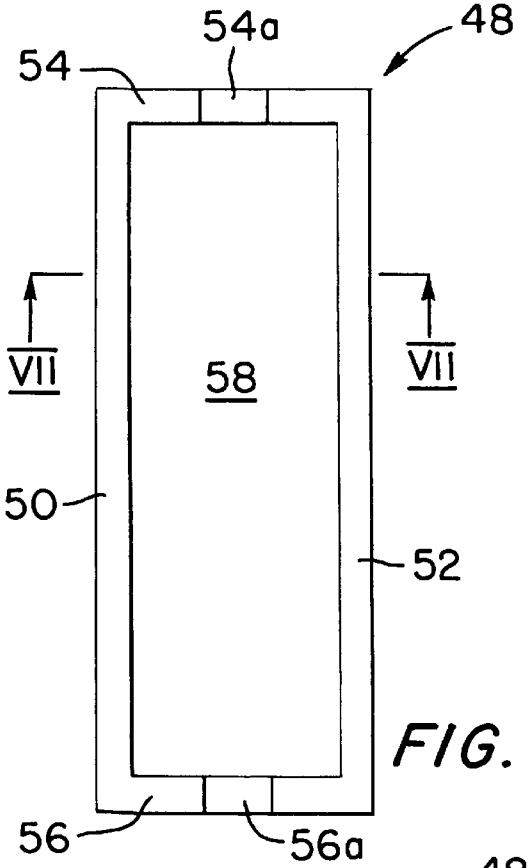
FIG. 5 is a top plan elevation of a second housing of a tag in accordance with the invention.
Figure 6:
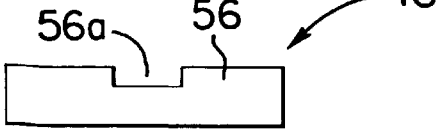
FIG. 6 is a front elevation of the FIG. 5 housing.

Turning to FIGS. 5–7, tag body housing 48 is a molded plastic member having outer sidewalls 50 and 52 and end walls 54 and 56. End wall openings 54*a* and 56*a* communicate with compartment 58 formed between sidewalls 50 and 52 and end walls 54 and 56.

Figure 9:
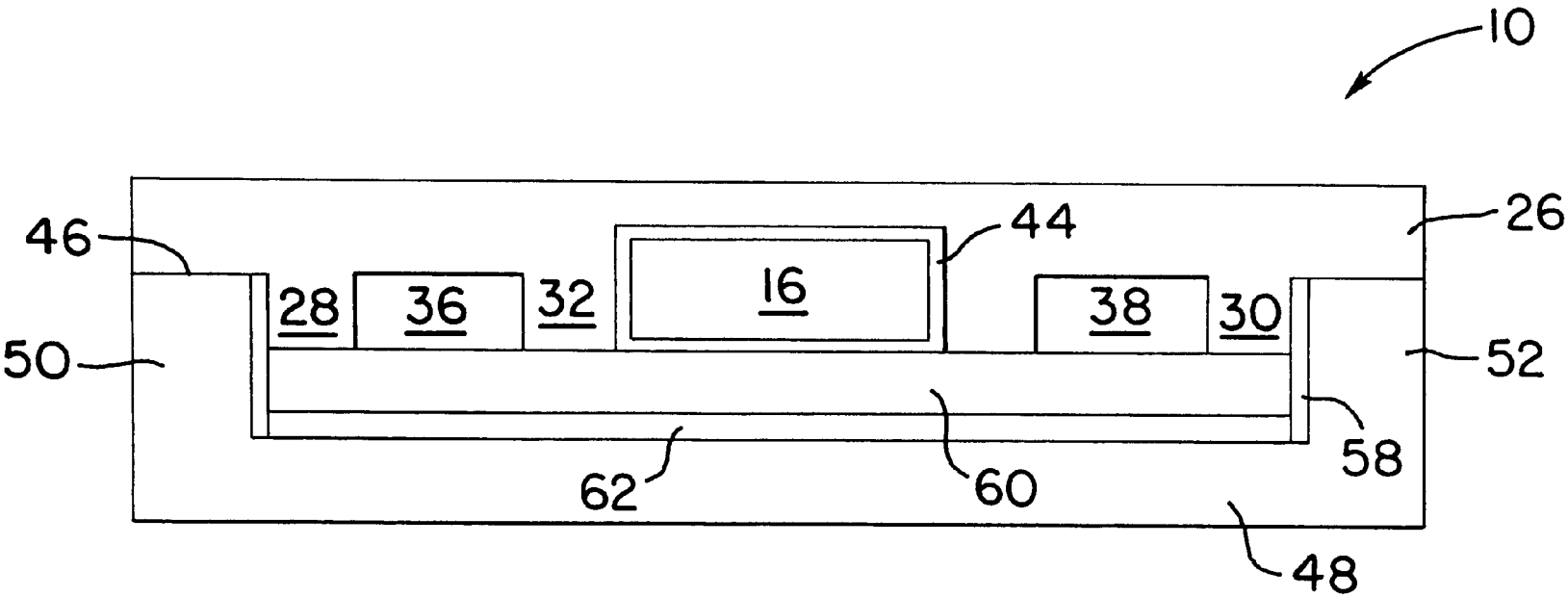
FIG. 9 is a cross-sectional view of the assembly of FIG. 8 as would be seen from plane IX—IX of FIG. 8, with sectioning omitted for clarity of illustration.

Referring to FIG. 9, tag 10 is shown assembled with securement member 16 disposed in channel 44 and with EAS member 60 secured in compartment 58 by adhesive backing 62 in juxtaposition with securement member 16. Outer sidewalls 28 and 30 and interior walls 32 and 34 are in engagement with EAS member 60 inhibiting self-damaging movement thereof as by bending or the like.

The assembly is effected first by disposition of EAS member 60 in compartment 58, then by placing housings 26 and 48 in juxtaposition and heat sealing joinder lip 40 to sidewalls 50 and 52. Securement member 16 is then passed through channel 44 to have its securement end members disposed exteriorly of tag 10.

Figure 10:
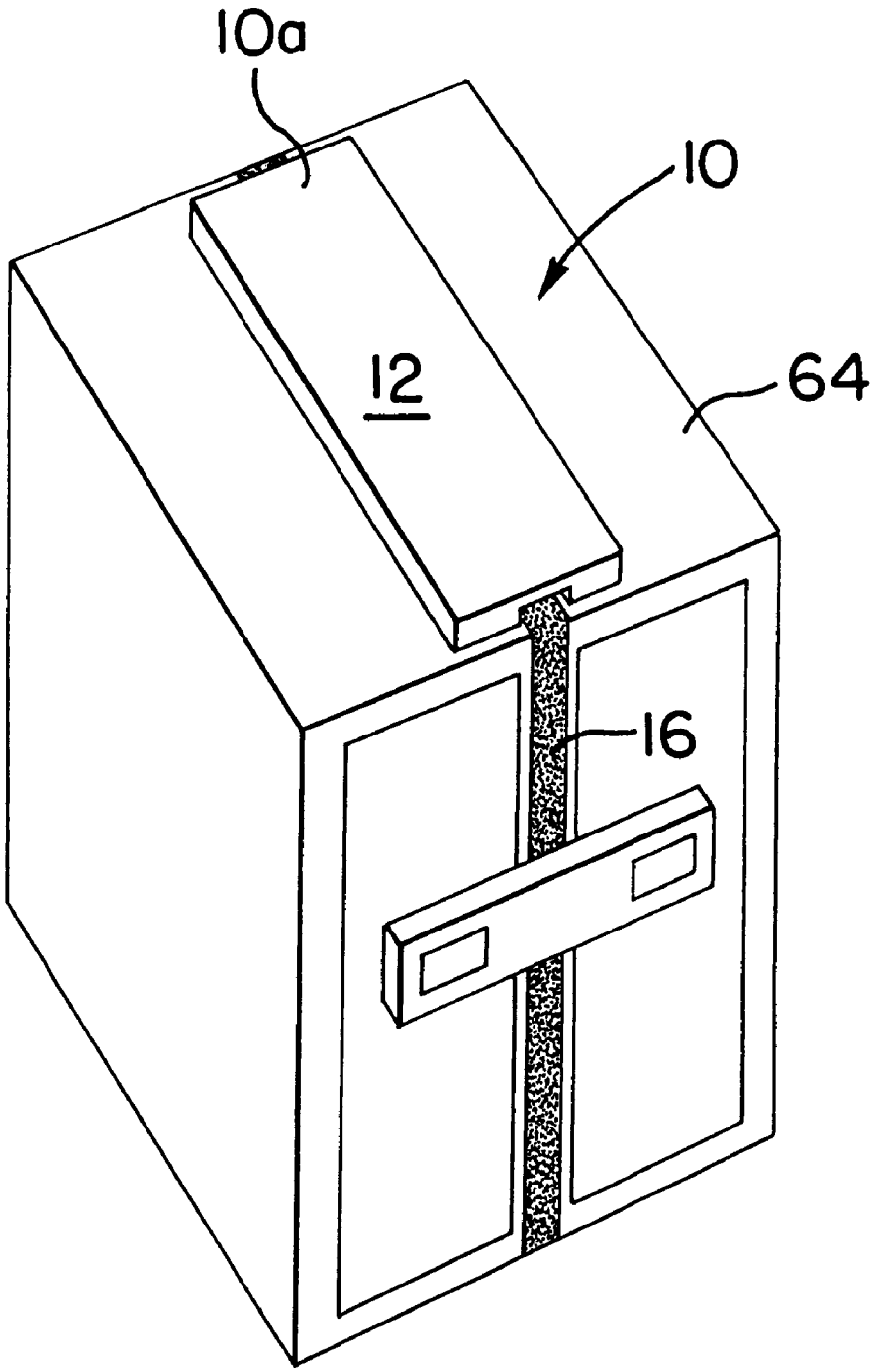
FIG. 10 shows the tag of the invention assembled with a circuit breaker.

With the tag so assembled, it may be arranged in circumscribing relation of an article of manufacture, such as circuit breaker 64 of FIG. 10, and with securement elements 18 and 22 interlocked after securement member 16 is tightly engaged with the article.

Channel 44 and securement member 16 are mutually configured to permit the latter to be inserted into tag body as previously assembled with resident EAS member. Accordingly, securement member 16 may be selected to be of length adaptive to the perimeter dimension of any article to be identified and protected. As respects identification, logo, bar code, pricing information, etc., the same may be placed on the exposed surface of the tag, e.g., surface 10*a* in FIG. 10.

Various changes may be introduced in the disclosed preferred embodiment without departing from the invention. For example, while the securement member illustrated is of the cable tie variety, other types of securement members may of course be employed in practicing the invention. Further, the EAS member compartment may include plural recesses for residence of plural EAS components. Accordingly, it is to be appreciated that the true spirit and scope of the invention is set forth in the following claims.

What is claimed is:

1. An article protection tag comprising:

a first housing defining a compartment therein;

a planar EAS member disposed in said compartment; and a second housing fabricated separately from said first housing and assemblable therewith, said second housing having opposed first and second sidewalls and first and second opposed end walls defining the outer boundary of said second housing, said second housing having first and second interior walls spaced from said sidewalls and continuous with said end walls, said first and second interior walls being spaced from one another to define a channel, said second housing, said first and second end walls defining respective first and second openings in registry with said channel, said first and second interior walls having depth in said second housing such as to engage said planar EAS member to preclude bending of said planar EAS member; and a securement member disposed in said channel and extending through said end walls openings to first and second connectable elements disposed exteriorly of said assembled first and second housings.

2. The tag claimed in claim 1, wherein said securement member is an elongate flexible member.

3. The tag claimed in claim 2, wherein said first connectable securement element includes a succession of ratcheting teeth longitudinally of said element.

4. The tag claimed in claim 3, wherein said second connectable securement element includes structure for latching engagement with any of said ratcheting teeth and configured such that said first connectable securement element is movable only in one direction with respect to said second connectable securement element.

5. The tag claimed in claim 1, wherein said securement member and said channel are mutually configured such that said securement member may be inserted through said channel after assembly of said first housing and said second housing.

6. In combination:

(a) an article of manufacture; and (b) an article protection tag comprising:

a first housing defining a compartment therein;

a palner EAS member disposed in said compartment; and a second housing fabricated separately from said first housing and assemblable therewith, said second housing having opposed first and second sidewalls and first and second opposed end walls defining the outer boundary of said second housing, said second housing having first and second interior walls spaced from said sidewalls and continuous with said end walls, said first and second interior walls being spaced from one another to define a channel in said second housing, said first and second end walls defining respective first and second openings in registry with said channel, said first and second interior walls having depth in said second housing such as to engage said planar EAS member to preclude bending of said planar EAS member; and a securement member disposed in said channel and extending through said end wall openings to seucurement member connected securement elements disposed exteriorly of said assembled first and second housings, said securement member circumscribing said article.

7. The invention claimed in claim 6, wherein said securement member is an elongate flexible member.

8. The invention claimed in claim 7, wherein said first connectable securement element includes a succession of ratcheting teeth longitudinally of said element.

9. The invention claimed in claim 8, wherein said second connectable securement element includes structure for latching engagement with any of said ratcheting teeth and configured such that said first connectable securement element is movable only in one direction with respect to said second connectable securement element.

10. The invention claimed in claim 6, wherein said securement member and said channel are mutually configured such that said securement member may be inserted through said channel after assembly of said first housing and said second housing.

11. An article protection tag comprising:

a first housing defining a compartment therein;

a planar EAS member disposed in said compartment; and a second housing fabricated separately from said first housing and assemblable therewith, said second housing defining a channel extending through said second housing to openings in opposed of said tag, said channel being contiguous with said compartment; and a securement member disposed in said channel in juxtaposition with said planar EAS member and extending through said openings of said first and second housings to connectable securement members disposed exteriorly of said assembled first and second housing.

12. The tag claimed in claim 11, wherein said securement member is an elongate flexible member.

13. The tag claimed in claim 12, wherein said first connectable securement element includes a succession of ratcheting teeth longitudinally of said element.

14. The tag claimed in claim 13, wherein said second connectable securement element includes structure for latching engagement with any of said ratcheting teeth and configured such that said first connectable securement element is movable only in one direction with respect to said second connectable securement element.

15. The tag claimed in claim 11, wherein said securement member and said channel are mutually configured such that said securement member may be inserted through said channel after assembly of said first housing and said second housing.

* * * * *

UNITED STATES PATENT AND TRADEMARK OFFICE

CERTIFICATE OF CORRECTION

PATENT NO. : 6,157,302
DATED : December 5, 2000
INVENTOR(S) : Chester Kolton et al.

It is certified that error appears in the above-identified patent and that said Letters Patent is hereby corrected as shown below:

Column 1,
Line 26, delete "article" and insert -- articles --.

Column 3,
Line 66, delete "palner" and insert -- planar --.

Signed and Sealed this

First Day of January, 2002

*Attest:*

*Attesting Officer*

JAMES E. ROGAN
*Director of the United States Patent and Trademark Office*